US005694213A

United States Patent [19]

Gable

[11] Patent Number: 5,694,213

[45] Date of Patent: *Dec. 2, 1997

[54] ADAPTER ENABLING COMPUTER SENSING OF MONITOR RESOLUTION

[75] Inventor: John Gable, San Jose, Calif.

[73] Assignee: Enhance Cable Technology, San Jose, Calif.

[ * ] Notice: The term of this patent shall not extend beyond the expiration date of Pat. No. 5,635,952.

[21] Appl. No.: 684,633

[22] Filed: Jul. 22, 1996

Related U.S. Application Data

[63] Continuation of Ser. No. 93,154, Jul. 19, 1993, Pat. No. 5,635,952.

[51] Int. Cl.[6] ..... G09G 5/00

[52] U.S. Cl. ..... 345/132; 345/1; 395/883

[58] Field of Search ..... 345/1, 3, 11, 132; 395/882, 883; 439/638, 651, 654, 655

[56] References Cited

U.S. PATENT DOCUMENTS 5,276,458 1/1994 Sawdon ..... 345/132

*Primary Examiner*—Mark R. Powell
*Assistant Examiner*—Matthew Luu
*Attorney, Agent, or Firm*—Ralph C. Francis

[57] ABSTRACT

An adapter for coupling a display monitor to a computer that controls the monitor generates any selected one of a number of codes that can be sensed by the computer and which identify the image resolution at which the particular monitor operates or a resolution that has been selected by the operator in the case of multi-sync monitors. A rotary hexadecimal switch, which may be operated by turning a dial, simplifies code selection and a multi-channel dip switch enables expansion of the number of available codes. The dip switch also enables selective changing of sync signal connections within the adapter to accommodate to different monitors that have different sync signal input requirements. The adapter may be a separable unit which can be interconnected between the computer and monitor or may be a permanent built in component of the monitor image data input cable. In an alternative embodiment, an array of dip switches are connected between the monitor and computer port to enable selection of sense codes by selective grounding of any of the sense lines to the computer. A pair of diodes are also connected by a pair of the dip switches in opposite bias fashion between two of the signal sense lines to direct current in either direction between the two sense lines.

10 Claims, 7 Drawing Sheets

ADAPTER ENABLING COMPUTER SENSING OF MONITOR RESOLUTION

REFERENCE TO RELATED APPLICATION

This patent application is a continuation-in-part of U.S. application Ser. No. 08/093,154, filed Jul. 19, 1993, now U.S. Pat. No. 5,635,952, for which priority is claimed.

TECHNICAL FIELD

This invention relates to the interfacing of computers and image display monitors and more particularly to cable adapters which enable a computer to identify the image resolution which is required by the particular monitor to which the computer is connected or a resolution which has been selected by the operator.

BACKGROUND OF THE INVENTION

Video monitors which display images generated by a computer are manufactured in a variety of types and in a variety of sizes. Different monitors require different control signals from the computer. Some monitors require control signals from the computer that establish a single specific degree of resolution in the image and the required resolution is different in different types of monitor. Most newer monitors are designed to enable operator selection of any of several specific resolutions. Thus the computer must provide different control signals to different monitors or to a single monitor if the operator wishes to change resolution.

Newer computers of the well known type manufactured by Apple Computer, Inc, and which are generally referred to by the trademarked name "Macintosh" or Mac" are available with an internal monitor controller built into the motherboard and which is known as "On Board Video". The controller is designed to sense the type of monitor to which it is connected provided that the monitor contains components which generate a resolution code that identifies the required resolution. The computer then provides monitor control signals that establish that particular resolution.

The original resolution coding, termed the "Sense Line Protocol" by Apple Computer, Inc, provided for seven different resolution codes. The system has since been extended and expanded to provide for additional codes.

Monitors designed for use with other types of computer, such as the MS-DOS type manufactured by IBM Corporation for example, do not have the resolution code generating components and also have cable connectors that differ from those of the Macintosh Computers. Many of these monitors have capabilities that can be highly useful to users of Macintosh computers.

Adapters have recently been introduced to the market which are designed to enable interfacing of the otherwise incompatible monitors and Macintosh computers. Adapters of this kind have a pin connector at one end that engages in the video port of the computer and a differing connector at the other end that conforms with the connector at the end of the monitor image date input cable. These recently commercialized adapters also contain components for producing the resolution code that the computer needs to sense in order to provide a resolution that is appropriate to the particular monitor but are subject to a number of limitations in this respect.

Some adapters of this kind are hardwired and thus can produce only a single code. This requires that a series of differing adapters be manufactured in order to meet the needs of different monitors and/or to provide different resolutions. Other adapters of this kind enable selection of any of a series of codes but have switching arrangements, such a plural dip switches that are difficult to adjust and which can be confusing to the user.

The adapters do not address other problems that can be encountered in interfacing monitors and computers including monitors and computers of the same manufacture. For example, such adapters do not enable adjustments to accommodate to the different synchronization signal input requirements of different types of display monitor.

SUMMARY OF THE INVENTION

In one aspect, the present invention provides an adapter for interconnecting a display monitor with a computer which provides image data to the monitor and which computer includes means for sensing resolution codes that identify the resolution at which the monitor is to operate. The adapter includes a first connector having means for engagement with the computer and having a first plurality of signal channels for receiving image data from the computer. The first connector also has a plurality of sense lines for enabling detection of the resolution codes by the computer. Output means transmits the image data to the monitor and has a second plurality of signal channels which are connected to the first plurality of signal channels. Manually operable rotary switch means provide for selectively establishing any selected one of the plurality of different electrical conditions at the sense lines, each of the conditions being a different resolution code that identifies a different monitor resolution.

In another aspect of the present invention, the adapter further includes means for selectively establishing unidirection current flow paths between selected ones of the sense lines.

In another aspect of the present invention, the rotary switch means is a hexadecimal switch having first, second and third terminals respectively connected to a first and a second and a third sense line. The switch has a plurality of switch settings including settings at which different combinations of the sense lines are interconnected by the switch.

In another aspect, the invention provides an adapter for coupling a display monitor to a computer which transmits image data to the monitor and which has means for sensing resolution codes that identify the resolution at which the monitor is to operate. The adapter includes a first connector having means for engagement with the computer and having a first plurality of signal channels for receiving image data from the computer. The first connector also has a plurality of sense lines for enabling detection of the resolution codes by the computer. Output means transmits the image data to the monitor and has a plurality of signal channels which are connected to the first plurality of signal channels. Manually operable switch means provide for selectively establishing any selected one of a plurality of different electrical conditions at the sense lines, each of the conditions being a different resolution code that identifies a different monitor resolution. Further components include a plurality of diodes and a plurality of diode selector switches, each sense line being selectively connectable with each other sense line through a different one of the diodes and a different one of the diode selector switches.

In another aspect, the invention provides an adapter for coupling a display monitor to a computer which transmits image data to the monitor, the adapter having a first connector which includes means for engagement with the computer and which has a first plurality of signal channels for receiving image data from the computer including sync signal channels. Output means transmits the image data to the monitor and has a second plurality of signal channels which are connected to the first plurality of signal channels. The adapter further includes sync signal routing means for enabling changing of the interconnections between sync signal channels of the first connector and channels of the output means.

The invention enables interconnection of computers and display monitors which otherwise may have incompatible characteristics such as a lack of resolution code generating means in the monitor and/or differing cable connector configurations. Preferred embodiments are also capable of adjusting sync signal output to match the differing needs of different types of monitors. In a preferred form, the adapter engages with the connector at the end of the monitor input signal cable and with the video port of the computer and has a rotary dial that may be set to generate any of the standard resolution sense codes thereby enabling the computer to generate monitor control signals that are compatible with the particular monitor or to change resolution as desired by the operator. Any resolution sense code in the extended and the expanded ranges can be generated by setting selected ones of the bank of additional switches in conjunction with setting of the rotary dial. The adapter may be a separate unit that is engageable with both the computer and the monitor or may be a permanent built in component of the monitor input cable.

The invention, together with further aspects and advantages thereof, may be further understood by reference to the following description of the preferred embodiments and by reference to the accompanying drawings.

DETAILED DESCRIPTION OF THE PREFERRED EMBODIMENTS

Figure 1:
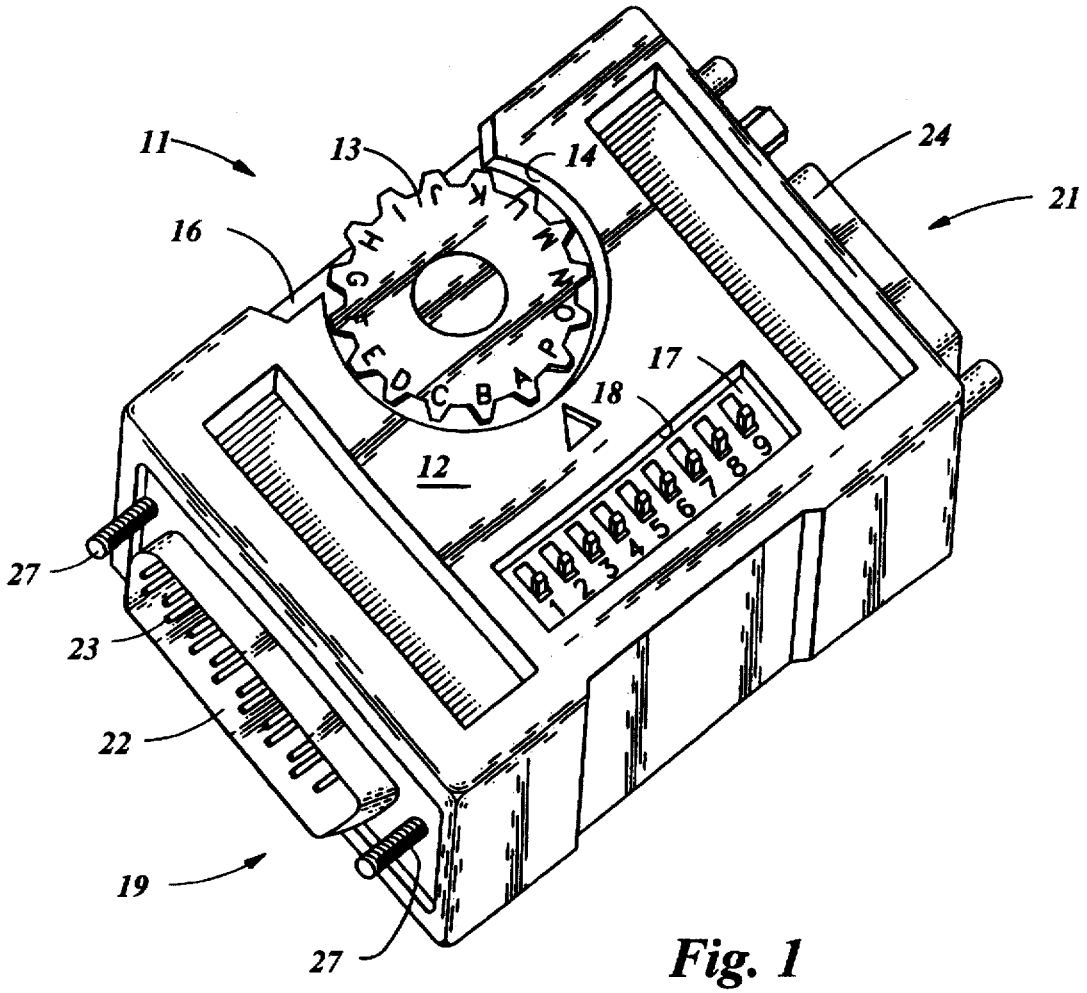
FIG. 1 is a perspective view of a monitor adapter in accordance with a first embodiment of the invention.
Figure 2:
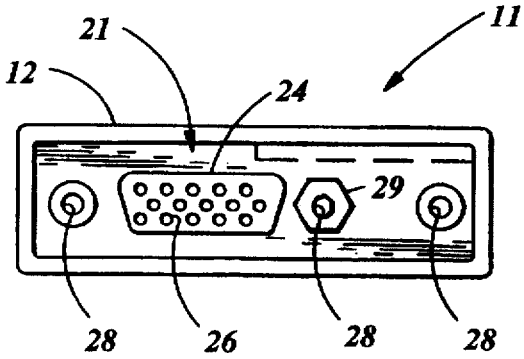
FIG. 2 is an end view of the adapter of FIG. 1 depicting the connector which engages with a monitor cable.

Referring initially to FIGS. 1 and 2 of the drawings, a display monitor adapter 11 in accordance with this embodiment of the invention has a body 12 which may be of generally rectangular shape and which may be formed of molded plastic, for example. External controls include a rotary dial 13 which is preferably situated in a conforming recess 14 in the top of the body 12 and which extends to a slot 16 at one edge of the body to facilitate turning of the dial by the operator's thumb. A nine channel dip switch 17 is situated within another conforming recess 18 in the top of body 12.

A first connector 19 for engagement with the video port of a computer is situated at one end of body 12 and a second connector 21 at the other end of the body engages with the control signal input cable of a display monitor and functions as output means for transmitting image data to a monitor. The adapter 11 of this example of the invention is designed for use with Mac computers of the type manufactured by Apple Computer, Inc. Thus the first connector 19 is a male pin connector of the standardized D-SUB 15 type which has an elongated shell 22 and two rows of connector pins 23, there being eight pins in the upper row and seven pins in the lower row.

This embodiment of the adapter 11 enables computers of the above described type to control display monitors which were originally designed for use with computers of the MS-DOS type such as are manufactured by IBM Corporation. Thus the second connector 21 has a different configuration and is a female connector of the standardized HD-SUB 15 form which has a smaller shell 24 and three rows of pin receptacles 26 with five receptacles in each row.

Thumbscrews 27 of the standardized type extend from one end of the adapter 11 to the other end adjacent the sides of body 12 to provide for a threaded engagement of the adapter with the computer port. The heads of the thumbscrews are provided with threaded bores 28 to enable a similar threaded engagement of a monitor cable connector with the adapter. In the present embodiment, a third head 29 with a threaded bore 28 is situated between the thumbscrews 27 and adjacent connector shell 24 to enable the threaded engagement with the smaller HD-SUB 15 connector at the end of the monitor cable.

Figure 3:
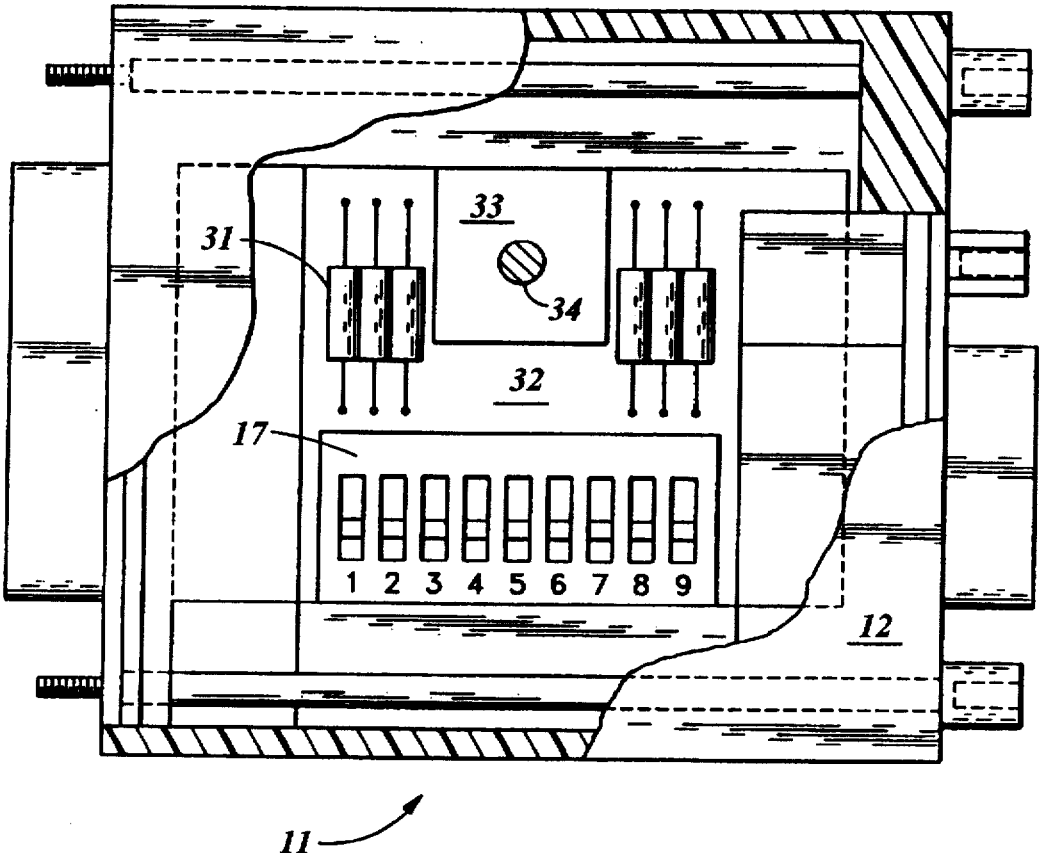
FIG. 3 is a broken out top view of the first embodiment showing internal components.
Figure 4:
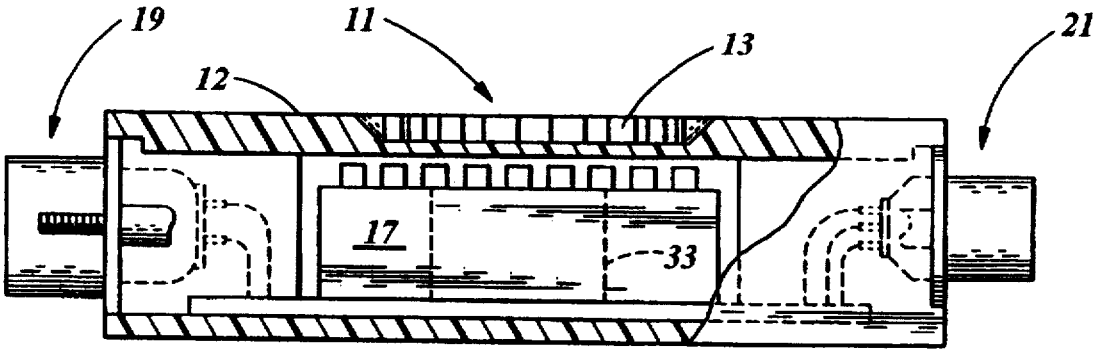
FIG. 4 is a broken out side view of the first embodiment.

Referring jointly to FIGS. 3 and 4, internal components of the adapter 11 include six diodes 31 attached to a printed circuit board 32 and a hexadecimal rotary switch 33, the electrical connections between such components being hereinafter described. The rotatable shaft 34 of switch 33 is turned by the previously described dial 13.

Figure 5:
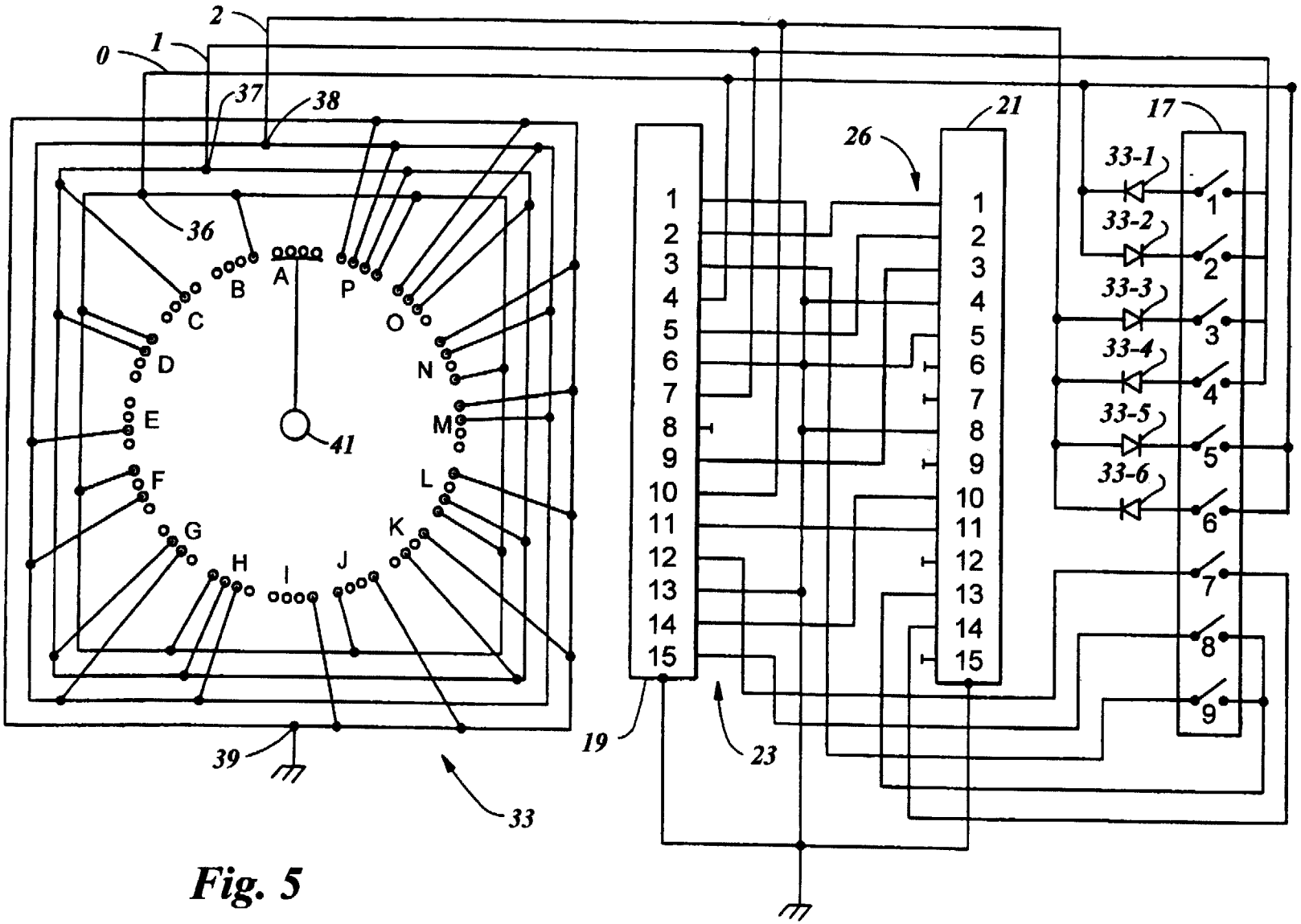
FIG. 5 is a circuit diagram showing electrical components of the first embodiment and interconnections therebetween.

With reference to FIG. 5, the pins 19 and 21 of first and second connectors 19 and 21 are interconnected in the depicted manner to adapt monitors of the above described type to a computer of the above described type although other pinout configurations, known in the art, are used with other types of monitor or computer. Pins 4, 7, and 10 of the first connector 19 are of particular interest in connection with the present invention as these pins connect with the three sense line 0, 1 and 2 that provide a resolution code to the computer. Sense lines 0, 1 and 2 connect with first, second and third terminals 36, 37 and 38 of the hexadecimal switch 33 and the switch has a fourth terminal 39 that is connected to the connector shells which function as a chassis ground for the circuit.

Hexadecimal switch 33, which may be of the RS 12 type, is a sixteen position switch having a common contact 41 that interconnects different combinations of the switch terminals 36, 37, 38 and 39 at different settings of the switch.

For purposes which will be hereinafter described, a first diode 31-1 is connected between sense lines 0 and 1 through a first switch channel of dip switch 17 and enables a unidirectional current flow from line 1 to line 0 when the switch channel is closed. The second diode 31-2 enables current flow from sense line 0 to sense line 1 when the second channel of dip switch 17 is closed. The third channel may be closed to enable current flow from sense line 2 to sense line 1 through the third diode 31-3 and the fourth channel may be closed to enable current flow from line 2 to line 1 through the fourth diode 31-4. Closure of the fifth channel allows current flow from line 2 to line 0 through diode 31-5 and closure of the sixth channel enables current flow from line 0 to line 2 through the sixth diode 31-6.

Figure 6:
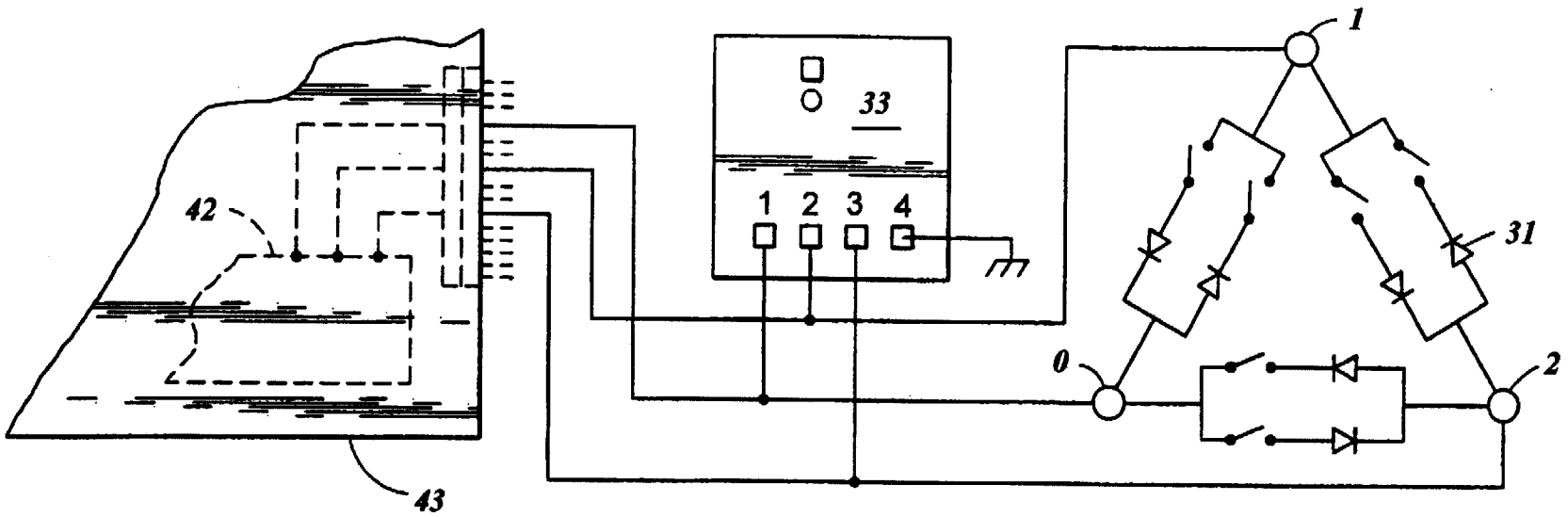
FIG. 6 is another circuit diagram showing portions of the circuit of FIG. 5 with certain components repositioned to facilitate an understanding of the operation of the invention.

Referring to FIG. 6, operation of the resolution code generating components may best be understood by viewing the sense lines 0, 1 and 2, diodes 31 and the switch channels of the dip switch as repositioned in FIG. 6. Electrical connections between such components remain the same as in FIG. 5. Displaying the sense lines 0, 1 and 2 in a triangular relationship as in FIG. 6 conforms with the standardized symbolic depiction of sense codes as provided by the manufacturer.

The On Board Video or monitor controller 42 of the computer 43 detects what resolution is needed by transmitting a voltage to each of the sense lines 0, 1 and 2 to determine if one or more of the sense lines are grounded. A total of seven different standard codes can be generated by grounding individual sense lines or different combinations of sense lines. The computer 43 is programmed to identify particular ones of the codes with particular resolutions at which the monitor is to be operated.

At any of the settings of hexadecimal switch 33 that are identified by letters J to P in FIG. 5, the common contact 41 of the switch connects individual ones of the sense lines 0, 1 and 2 or different combinations of such lines to ground through the grounded switch terminal 39. At setting I, all sense lines are ungrounded. Thus the switch may be set to generate any selected one of the seven standard sense codes to inform the computer of the desired resolution. Referring again to FIG. 1, the letters A to P or other equivalent symbols are displayed at angularly spaced locations around the rotatable dial 13 to identify the sixteen switch settings and the dial may be turned to position any selected letter at a locator arrow 40 which is displayed on the adapter body 12 at a location that is adjacent the dial. The operator is provided with a listing of the resolutions that are encoded at the different settings identified by the letters or the like, preferably on a label (not shown) that is adhered to the underside of the adapter body 12.

Referring again to FIG. 6, the newer extended sense codes are produced by a different technique. If the computer initially detects an ungrounded condition at all three sense lines 0, 1 and 2, it is programmed to apply voltage to line 0 and to sense if the voltage also appears on one or both of lines 1 and 2. The computer 43 then applies voltage to line 1 and detects if voltage also appears on one or both of lines 0 and 2. Voltage is then applied to line 2 and the computer detects if the voltage also appears on one or both of lines 0 and 1. The computer 43 assigns a binary value of 0 to the absence of voltage on a sense line to which voltage is not being directly applied and a value of 1 to the presence of voltage on a line to which the voltage is not being directly applied and thereby acquires a six bit binary code which identifies the desired resolution. Different pairs of the sense lines 0, 1 and 3 are interconnected through switch 33 at different settings of the switch and thus the operator may select the particular code that is generated. Referring again to FIG. 5, settings A to H of hexadecimal switch 33 provide the different interconnections of sense lines that produce the extended sense codes.

The range of available sense codes can be further expanded by establishing unidirectional current flow paths between sense lines 0, 1 and 2 rather than two way flow paths. The computer 43 senses a different binary code if a unidirectional path is present as opposed to a two way flow path. Selected ones of the dip switch 17 channels may be closed to establish such unidirectional flow paths. The first six channels of dip switch 17 function as diode selector switches and enable selective interconnection of a diode 31 between any pair of the sense lines 0, 1 and 2 to create a unidirectional current flow path therebetween and selective interconnection of an oppositely oriented diode between any pair of the lines to establish a reversed unidirectional flow path. Referring again to FIG. 1, the channels of dip switch 17 are identified by visible numbers so that the operator may follow instructions which identify the channels that need to be closed to create a given resolution code.

Referring again to FIG. 5, the additional switch channels 7, 8, and 9 of dip switch 17 are used as sync signal routing means for enabling changing of the interconnections between sync signal receiving channels of the first connector 19 and the channels of the second connector 21 as may be needed to accommodate to the different sync signal requirements of different types of monitor. In the present example, a computer of the above identified type transmits a composite sync signal to pin 3 of the first connector 19, a vertical sync signal to pin 12 of that connector and a horizontal sync signal to pin 15 of the connector. Dip switch channel 7 enables selective application of the composite sync signal from pin 3 of first connector 19 to pin receptacle 14 of the second connector 21. Dip switch channels 8 and 9 are connected in this embodiment of the invention and enable pin receptacle 13 of the second connector 21 to receive either the vertical sync signal from pin 12 of first connector 19 or the horizontal sync signal from pin 15 of the first connector depending on the requirements of the particular monitor. The requirements of particular monitors with respect to sync signal input are made available by the manufacturer.

Figure 7:
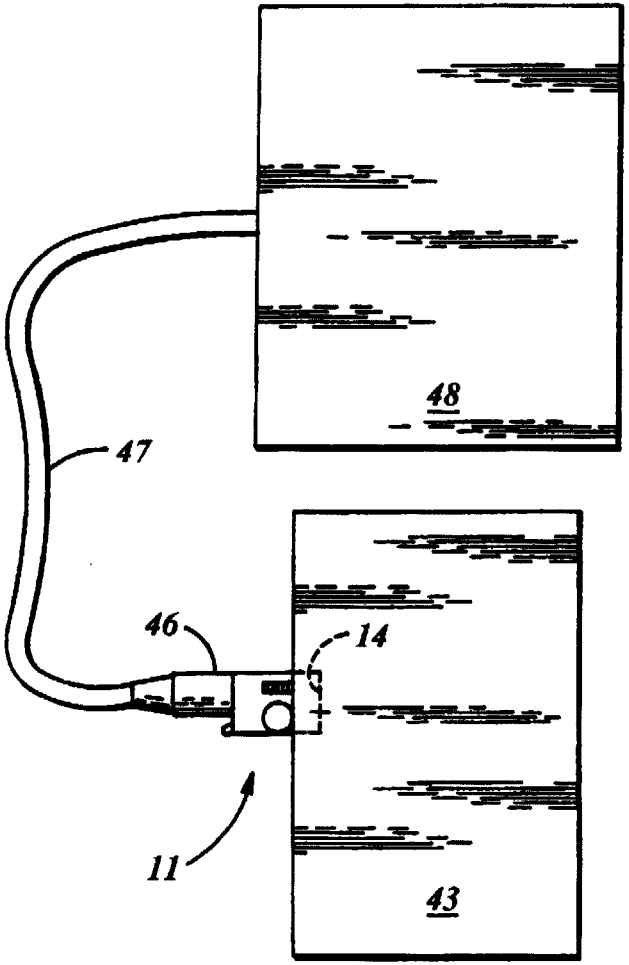
FIG. 7 is a top view showing the adapter of the preceding figures in engagement with a display monitor and a computer.

Referring to FIG. 7, in use the adapter is engaged in the video port 44 of the computer 43 in place of the built in connector 46 at the end of the control signal input cable 47 of the display monitor 48. The cable connector 46 is then engaged with the second connector 21 of the adapter 11.

Figure 8:
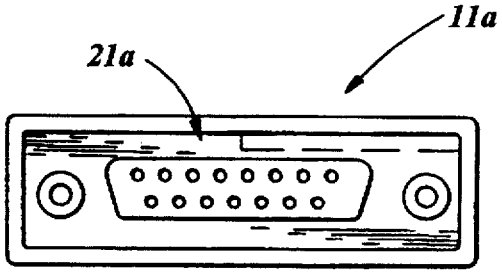
FIG. 8 is an end view of a second embodiment of the invention which has a different connector configuration in order to engage with monitors having a different type of cable connector.
Figure 9:
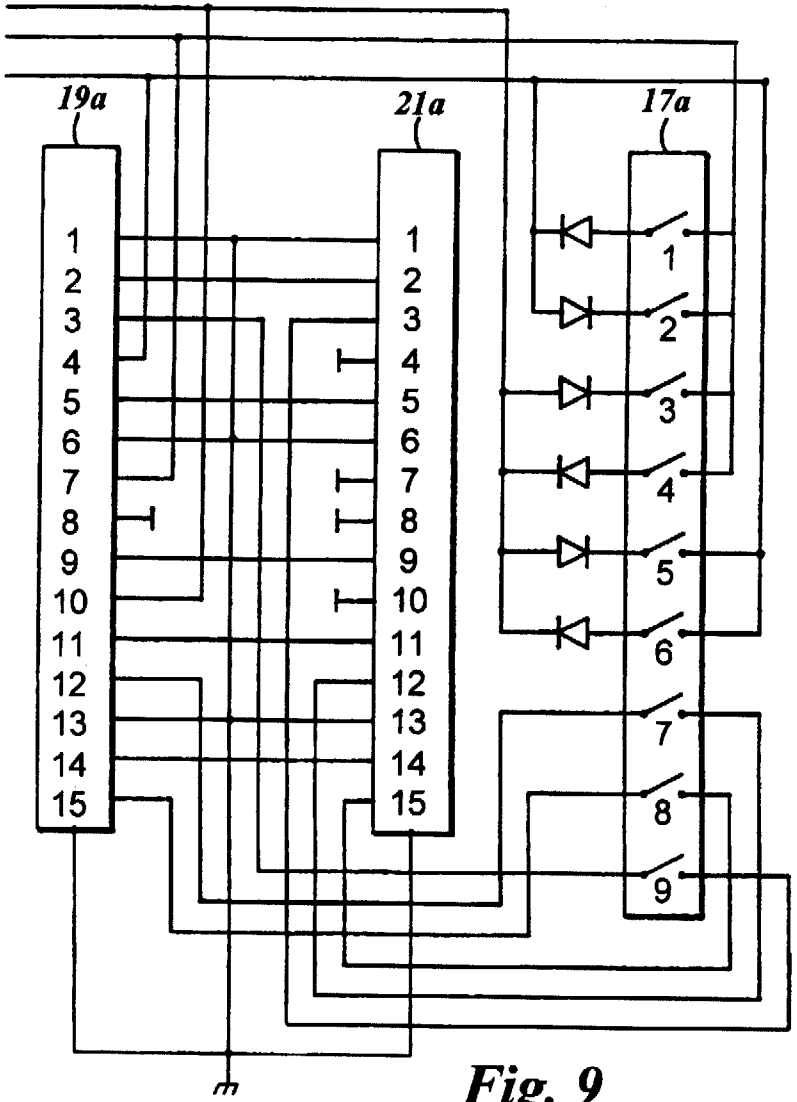
FIG. 9 is a circuit diagram showing connector pin connections that are appropriate for the embodiment of FIG. 8.

The above described embodiment of the adapter 11 has differing connectors at opposite ends to enable coupling of a Mac computer with a monitor having a different form of input cable connector. Referring to FIG. 8, the second connector 21*a* may be identical to the first connector 19, shown in FIG. 1, in some cases such as in adapters 11*a* which are designed to couple Mac computers with computers that were designed for use with that type of computer. This requires a different interconnection of the pins and pin receptacles of the first and second connectors 19*a* and 21*a* and the terminals of dip switch channels 7, 8, and 9 as shown in FIG. 9. The adapter 11*a* may otherwise be similar to the first embodiment of the invention as previously described.

Figure 10:
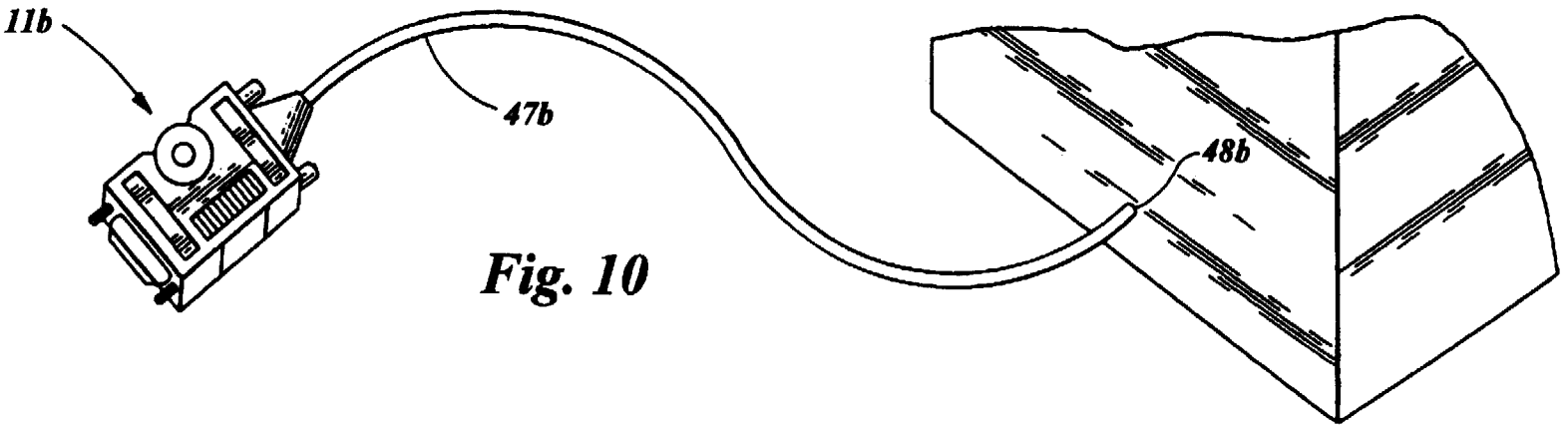
FIG. 10 is a perspective view showing a modification of the invention in which the adapter is a built-in connector at the end of a display monitor control signal input cable.
Figure 12:
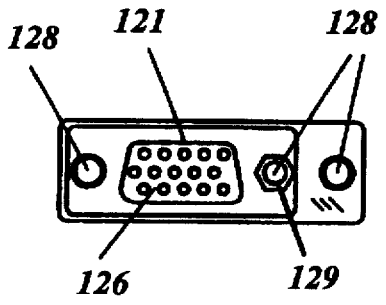
FIG. 12 is an end elevation of the monitor adapter shown in FIG. 11.
Figure 13:
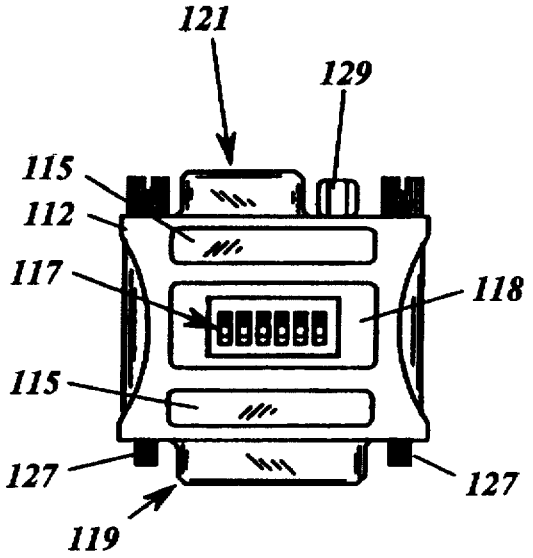
FIG. 13 is a top plan view of the embodiment of FIGS. 11 and 12.
Figure 14:
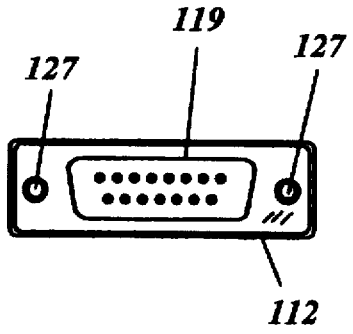
FIG. 14 is an opposite end view of the monitor adapter of FIGS. 11–13.
Figure 15:
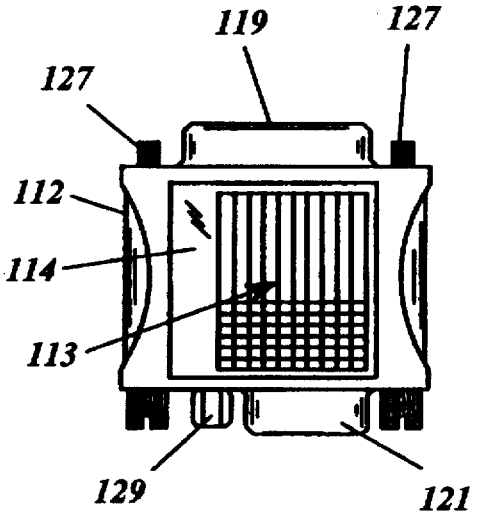
FIG. 15 is a bottom plan view of the monitor adapter of FIGS. 11–14.
Figure 11:
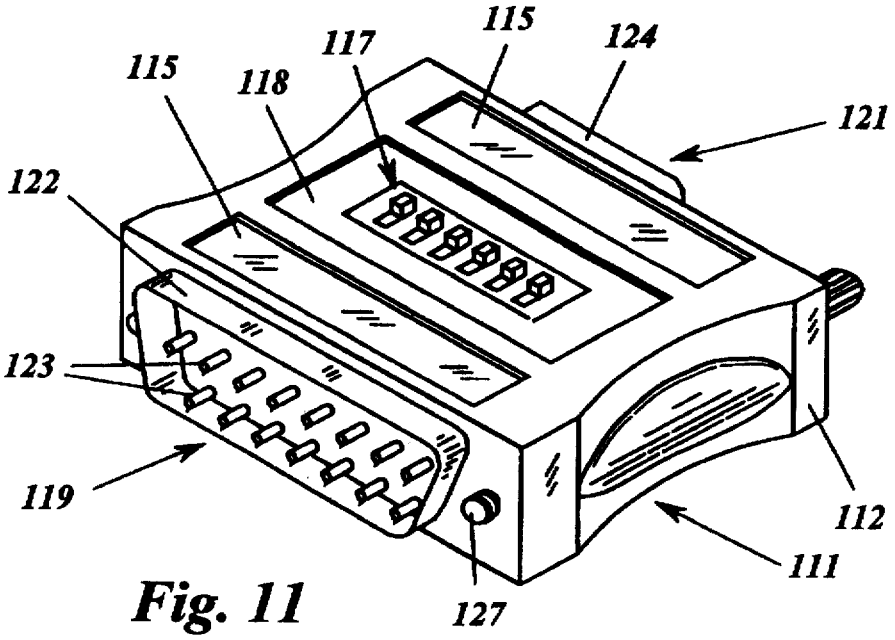
FIG. 11 is a perspective view of a further embodiment of the monitor adapter featuring a plurality of dip switches.

The above described adapters are discrete units that are separable from both the computer and the monitor. Referring to FIG. 10, an essentially similar device 11*b* can replace the connector which is otherwise present at the end of the control signal input cable 47*b* of a monitor 48*b* and thus be a built in component of the cable that is permanently attached to the cable. A second connector of the previously described type is not necessarily required in an adapter 11*b* of this kind as the signal conductors of the cable 47*b* may be directly connected to the pins of the first connector 19*b* of the adapter 11*b* and to the dip switch. 17*b* in the manner previously described with reference to the pin receptacles of the second connector. The adapter 11*b* may otherwise be similar to one of the previously described embodiments of the invention.

A further embodiment of the invention, shown in FIGS. 11–15 of the drawings, provides a simplified construction that makes available selection of the most commonly used display sense codes. A display monitor adapter 111 has a body 112 which may be of generally rectangular shape and which may be formed of molded plastic, for example. External controls include a six channel dip switch 117 situated within a conforming recess 118 in the top of body 112. Recesses 115 are provided in top of body 112 at both ends of the recess 118 to receive and display labeling such as a corporate name and/or logo. Another, larger recess 114 formed centrally in the bottom surface of the body 112 is provided to receive and display a graphical representation 113 that correlates dip switch 117 settings with monitor size and display mode.

A first connector 119 for engagement with the video port of a computer is situated at one end of body 112 and a second connector 121 at the other end of the body engages with the control signal input cable of a display monitor and functions as output means for transmitting image data to a monitor. The adapter 111 of this example of the invention is designed for use with Mac computers of the type manufactured by Apple Computer, Inc. The first connector 119 is a male pin connector of the standardized DB 15 type which has an elongated shell 122 and two rows of connector pins 123, there being eight pins in the upper row and seven pins in the lower row.

The embodiment 111 enables computers of the above described type to control display monitors which were originally designed for use with computers of the MS-DOS type such as are manufactured by IBM Corporation. The second connector 121 may have a different configuration and is preferably a female connector of the standardized HDB 15 form which has a smaller shell 124 and three rows of pin receptacles 126 with five receptacles in each row.

Thumbscrews 127 of the standardized type extend from one end of the adapter 111 to the other end adjacent the sides of body 112 to provide for a threaded engagement of the adapter with the computer port. The heads of the thumbscrews are provided with threaded bores 128 to enable a similar threaded engagement of a monitor cable connector with the adapter. In the present embodiment, a third head 129 with a threaded bore 128 is situated between the thumbscrews 127 and adjacent connector shell 124 to enable the threaded engagement with the smaller DB 15 connector at the end of the monitor cable.

Figure 16:
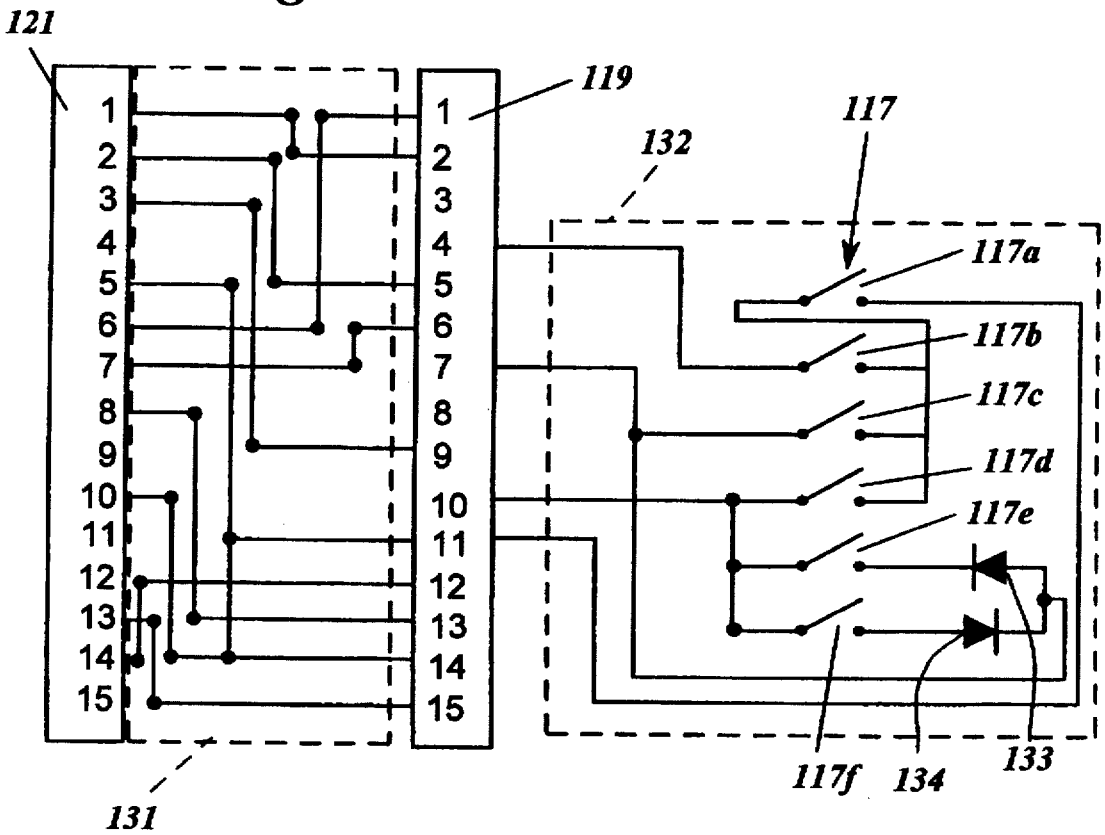
FIG. 16 is a schematic representation of the electrical connections of the embodiment of FIGS. 11–14.

Within the body 112 a circuit board is secured, as generally described previously, which embodies the connections depicted in FIG. 16. The fixed interconnections between computer video port connector 119 and video cable connector 121 are made by the hardwired circuit 131, and the video monitor selection is made by adjusting the settings of the six elements 117*a*–117*f* of the dip switch 117. As described previously, sense lines 0, 1, and 2 are derived from pin assignments 4, 7, and 10 of the connector 119, and pin 11 of connector 119 is connected to signal ground by virtue of a jumper connection that joins horizontal sync ground and vertical sync ground on pins 5 and 10, respectively, of connector 121.

The normally open pole of switch 117*a* is connected to signal ground, and the other switch leg is connected to the nonflatly open poles of switches 117*b*–117*d*. Switches 117*b*–117*d* are connected directly to pins 4, 7, and 10, and appropriate selection of switches 117*b*–117*d* together with closure of switch 117*a* permits grounding of any combination of sense lines 0, 1, and 2, and also permits shorting of any and all sense lines. In addition, the circuit provides two diodes 133 and 134 connected in opposite polarity between pin 7 (sense line 1) and the normally open poles of switches 117*e* and 117*f*. The switch legs of these latter switches are both connected to pin 10 (sense line 2) of connector 119. Switches 117*e* and 117*f* may be set to permit forward biased, reversed biased, shorted, or open connection between pins 7 and 10 of connector 119.

The embodiment 111 permits the selection of the most commonly used video monitor sense codes while using only two diodes and eliminating a rotary selector switch. Currently, it serves multimode and VGA/SVGA monitors in a range of sizes and resolutions, as well as a selection of Apple 15 inch monitors.

It should be noted that grounding of sense lines in the embodiment 111 is accomplished through connection to the signal ground (pin 11), not with the chassis ground as in the previous embodiment. Thus all signals are contained within the shell of the connector, and are not conducted to the chassis where signal radiation is possible. Other features of embodiments described previously may be combined in the embodiment 11 as is practical and desirable.

While the invention has been described with reference to certain specific embodiments for purpose of example, many variations and modifications of the adapter are possible and it is not intended to limit the invention except as defined by the following claims.

I claim:

1. An adapter for coupling a display monitor to a computer which transmits image data to the monitor and which computer has means for sensing resolution codes that identify the size and resolution at which the monitor is to operate, said adapter including:

a first connector having means for engagement with said computer and having a first plurality of signal channels for receiving said image data from said computer, said first connector further having a plurality of sense lines for enabling detection of said size and resolution codes by said computer;

output means for transmitting said image data to said monitor, said output means having a plurality of signal channels which are connected to said first plurality of signal channels; and, manually operable switch means for selectively establishing any selected one of a plurality of different electrical conditions at said sense lines, each of said conditions being a different resolution code that identifies a different monitor resolution and size.

2. The adapter of claim 1, wherein said switch means includes a plurality of dip switches selectively settable to establish said different electrical conditions.

3. The adapter of claim 2, further including a first subset of said dip switches connected to said sense lines, a second subset of said dip switches connected to grounding means, and first circuit means for connecting said first and second subsets of dip switches to enable selective grounding of any of said sense lines.

4. The adapter of claim 3, further including a third subset of said dip switches each connected to a respective diode, and second circuit means for connecting said third subset of dip switches between two of said sense lines.

5. The adapter of claim 3, wherein said grounding means includes a signal ground pin connection in said first connector.

6. The adapter of claim 5, wherein said second subset of said dip switches is connected between said signal ground pin connection and said first subset of said dip switches.

7. The adapter of claim 4, wherein said third subset of said dip switches includes a pair of said dip switches, each having like switch poles connected to a respective one of a pair of diodes, said pair of diodes connected in opposing bias fashion, whereby said pair of dip switches are Seattle to direct unidirectional current flow in either direction between said two sense lines.

8. The adapter of claim 1, further including a first adapter surface, and a first recess disposed in said first adapter surface, wherein said manually operable switch means comprises a plurality of dip switches extending outwardly from said first recess.

9. The adapter of claim 8, further including a second recess disposed adjacent to said first recess and adapted to display an identifying logo.

10. The adapter of claim 8, further including a second adapter surface disposed in generally obverse relationship to said first adapter surface, and second recess means disposed in said second adapter surface to display a graphic correlation of settings of said dip switches with respect to said electrical conditions.

* * * * *